United States Patent [19]

Wright

[11] 4,058,982

[45] Nov. 22, 1977

[54] MODULAR HEATING SECTION

[76] Inventor: Ralph Wallace Wright, 118 Cedar Ave., Hudson, Quebec, Canada

[21] Appl. No.: 613,583

[22] Filed: Sept. 15, 1975

[51] Int. Cl.[2] ..... E02B 15/02

[52] U.S. Cl. ..... 61/1 R; 61/7; 62/260; 165/45; 165/168; 165/49; 219/213; 219/548

[58] Field of Search ..... 61/1 R, 2, 7, 36 A; 165/45, 49; 404/17, 27, 71, 79, 95; 62/260

[56] References Cited

U.S. PATENT DOCUMENTS

| | | | |
|---|---|---|---|
| 90,727 | 6/1869 | Chesebrough | 61/7 X |
| 279,901 | 6/1883 | Martine | 61/7 X |
| 838,564 | 12/1906 | Murphy | 61/1 R |
| 2,876,326 | 3/1959 | Akmentin | 404/17 X |
| 3,768,264 | 10/1973 | Best | 61/1 R |
| 3,782,132 | 1/1974 | Lohoff | 165/49 X |

*Primary Examiner*—Paul R. Gilliam
*Assistant Examiner*—David H. Corbin
*Attorney, Agent, or Firm*—Diller, Brown, Ramik & Wight

[57] ABSTRACT

A modular heating section for removing or preventing the formation of ice on the walls of navigation locks, loading docks, ferry slips, or the like. Ice formation on the walls of navigation locks is compressed by successive vessels to the extent that larger vessels are unable to enter the locks. To avoid this happening, ice is chipped from the walls of the locks, which is time-consuming. As well, chipping of the ice results in damage to the concrete walls which must then be repaired. To overcome this problem, the present invention proposes the use of a modular heating section comprising a rigid panel having means for securing the section to a navigation lock wall, loading dock, or the like at a location where ice formation occurs, the panel being made from a heat conducting material. The panel includes heater means situated therein, the heater means adapted to distribute heat throughout the modular heating sections. Connector means are operatively connected with the heater means, said connector means adapted to connect the heater means to an energy supply, with individual or multiple control of heat to the panels, depending upon the area of surface to be heated. A rear surface of the modular heating section is provided with a layer of heat insulating material, whereby heat transfer through the rear surface of the panel to the lock wall, loading dock, or the like is limited. The modular heating section is adapted to prevent the accumulation of ice on lock walls, loading docks, ferry slips, or the like by providing heat to an outer surface of the modular heating section by means of the heater means.

10 Claims, 3 Drawing Figures

MODULAR HEATING SECTION

BACKGROUND OF INVENTION a. Field of the Invention

The present invention relates to modular heating sections which, when used in association with locks, loading docks, ferry slips, or the like, can be utilized to prevent the accumulation of ice on the walls of such structures.

b. Description of Prior Art

In the past, problems have been encountered during the winter months due to the adhesion of ice to concrete walls of navigation locks, loading docks, and ferry slips. The formation of ice, for example, within a navigation lock occurs as a result of the flow of ice into the navigation lock as a vessel enters the same. Lateral movement of the vessel within the lock towards the walls of the navigation lock compresses the floating ice against the walls of the lock, the resulting compressive forces causing the ice to adhere to the side walls of the navigation lock. The ice adheres to the walls at the water line over a height of up to five feet, with ice thicknesses reaching as much as two to three feet. The buildup of ice can have the effect of impeding navigation, particularly in navigation locks, due to the constant danger of large vessels becoming wedged in the locks. Similar ice formation, which also occurs at loading docks and ferry slips, interferes with the navigation of vessels at these locations.

In the past, the problem of ice accumulation has been overcome by manually chipping ice away from the concrete wall after its formation. Additionally, attempts have been made to utilize chemicals and flame throwers to melt the ice. However, these methods have been found to be very inconvenient and hazardous, as well as time-consuming and costly. Further, these methods of ice removal result in damage to the concrete walls, thereby necessitating repairs thereto.

SUMMARY OF INVENTION

To prevent the accumulation of ice on the walls of navigation locks, as well as on the walls of loading docks and ferry slips, it is proposed to utilize modular heating sections which can be mounted on the walls at the locations of ice formation, the modular heating sections adapted to provide sufficient heat in order to prevent the accumulation of ice on the outer surfaces thereof.

According to the present invention, the modular heating section for use in association with navigation lock walls, loading docks, ferry slips, or the like, said modular heating section comprises a rigid panel having means for securing the section to a navigation lock wall, loading dock, or the like, at a location where ice formation occurs, the panel being made from a heat conducting material. The panel includes heater means situated therein, the heater means adapted to distribute heat throughout the modular heating sections. Connector means are operatively connected with the heater means, said connector means adapted to connect the heater means to an energy supply. A rear surface of the modular heating section is provided with a layer of heat insulating material, whereby heat transfer through the rear surface of the panel to the lock wall, loading dock, or the like is limited. The modular heating section is adapted to prevent the accumulation of ice on lock walls, loading docks, ferry slips, or the like by providing heat to an outer surface of the modular heating section by means of the heater means.

BRIEF DESCRIPTION OF DRAWINGS

In a drawing which illustrates one embodiment of the present invention.

DESCRIPTION OF PREFERRED EMBODIMENTS

Figure 1:
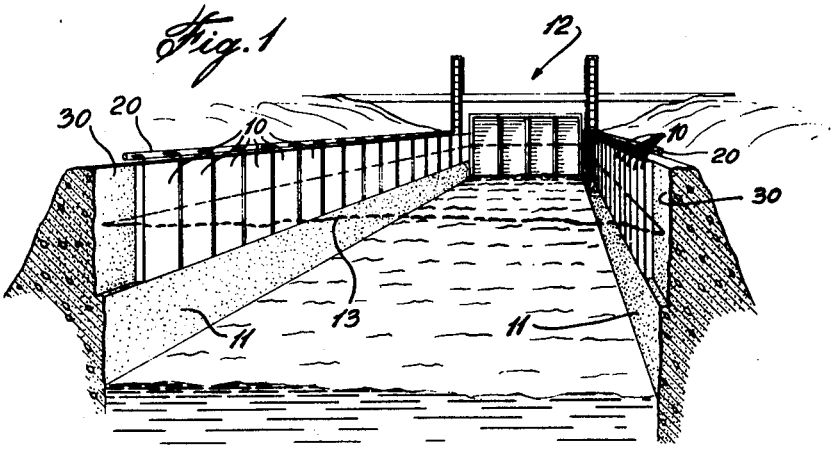
FIG. 1 is a perspective view illustrating a navigation lock with modular heating sections according to the present invention installed in position.

In the drawing, the embodiment of the modular heating section is indicated generally by reference 10. As best seen in FIG. 1, a number of heating sections 10 are secured to opposite walls 11 of a navigation lock 12. The locations at the sections are adjacent the normal water level 13, when a vessel is in the navigation lock, this being the location of ice formation on the walls of the locks. When the water is at its level 13 in the lock 12, a portion of each section 10 is situated beneath the water level. The dimensions of each section, and particularly the height and location thereof on the wall of the lock will vary with the normal variation in water levels at a particular location during the winter months. Certainly, where there is limited seasonal variations in water levels within the navigation locks, the height of the sections will be less than at locations where larger seasonal variations in water levels occur.

Each of the modular heating sections 10 comprise a panel constructed from an epoxy or other mortar mix having a high compressive strength in order to withstand the excessive compressive stresses resulting from the lateral movement of vessels within the navigation lock. Further, the outer surface 14 of the panel includes a smooth and hard abrasive resistant layer designed to minimize the formation of ice thereon. The smoothness of the surface 14 also avoids peeling of the outer layer when a vessel rubs against the surface. To achieve the necessary smoothness and hardness of the surface, an appropriate epoxy mix can be utilized.

Heater means 16 are situated within the heating section 10 in order to heat the outer surface 14 of the section 10, thereby preventing the formation of ice thereon. The heater means illustrated in FIGS. 2 and 3 comprise a soil cable or other suitable electrical conductor adapted to provide heat energy within the section 10. The heat capacity of the conductor will vary depending upon the length of cable located within the section 10. Opposite ends of the cable are provided with connector means 18 for connecting the modular section 10 to a header 20.

Each section 10 includes an insulating backing 22 which is coated on each of its surfaces with an epoxy bonding layer 24. In order to improve the strength of the layer 24, the same may be provided with fibreglass stripping or sheet. The bonding layer 24 increases the adhesion of the insulating layer 22 to the section 10. By utilizing the insulating backing 22, heat transfer through the rear surface of the heating section 10 is minimized, thereby increasing the effective heat within the section 10 which can be utilized for preventing the formation of ice on the outer surface 14 thereof.

Figure 2:
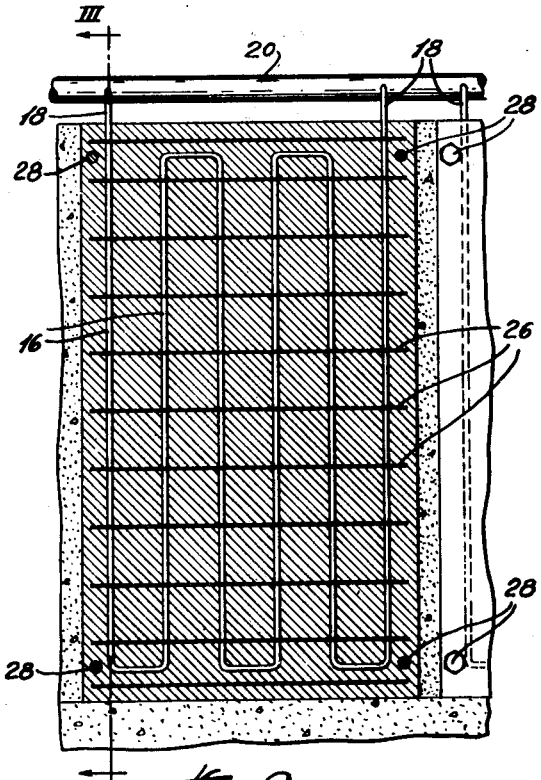
FIG. 2 is a vertical section of a modular heating section located in position, taken along the line II—II of FIG. 3.
Figure 3:
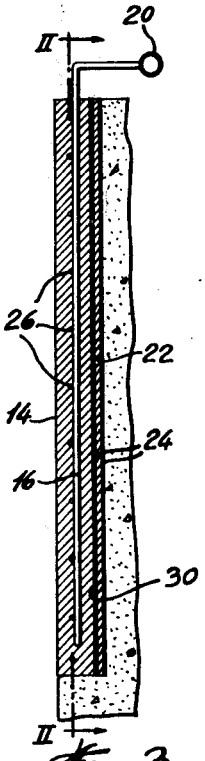
FIG. 3 is a vertical section of the heating section according to FIG. 2, taken along the line III—III.

As seen in FIGS. 2 and 3, the modular heating section 10 is provided with heat distribution and reinforcing elements 26 situated within each modular heating section between the outer surface 14 and the heater means 16. The elements 26 utilized can be reinforcing steel which is designed to provide reinforcement to the sections 10, as well as providing some distribution of heat across the outer surface 14 of the heating section. The arrangement of elements 26 within each section 10 is substantially at right angles to the principal direction of the heater means 16 within the section, thereby improving the effective heat distribution provided by elements 26. However, the elements 26 can be situated within the section 10 at other than right angles to the heater means 16. The panels are secured in position to the lock walls 11 by means of suitable anchors 28 which are inserted through appropriate openings provided in the heating sections 10.

In order to manufacture modular heating sections 10, a heat insulating layer 22 of asbestos, or other suitable material, is covered on both sides with a thin layer 24 of epoxy coating, which itself may be further reinforced with fibreglass stripping or sheet. Heater means 16 are then placed on top of the coated insulating layer 22 and the heat distribution and reinforcing elements 26, such as reinforcing steel, are then placed in position in order to prevent collapse of the heater means due to forces generated by lateral movement of vessels within a navigation lock.

An epoxy or other mortar mix is then poured around and over the heating elements 16 and elements 26, with provision being made for openings by means of which the sections 10 are secured by suitable anchors 28 to the wall 11 of a navigation lock 12. Further, a layer of screening, made from aluminium or other suitable heat conducting material, may be situated between the outer surface 14 of the heating section 10 and the heater means 16 in order to improve conductivity of heat to the outer surface 14 of the section. The outer surface 14 and edges are then covered with a thin reinforcing coating of epoxy in order to improve the smoothness and hardness thereof, thereby limiting abrasion due to sliding contact with a vessel. While epoxy mortar mix has been suggested as a material which can be utilized in the manufacture and bonding of the sections 10, other mixes can be utilized so long as the concrete provides an adequate bond to the heater means. Epoxy has been found adequate to provide the necessary bonding while adding to the compressive strength of the sections 10. A further advantage of the present sections is that the same can be fabricated in a horizontal position, thereby facilitating proper placement of the heater means 16, the elements 26, and the heat insulating layer relative to each other.

The modular heating sections are then taken to the field and supported in an appropriate manner. In order to avoid a reduction in the overall width of the lock, as well as to provide additional support for sections 10, the lock wall 12 is provided with recessed sections 30, the wall 12 having been previously chipped back and coated with a thin layer of epoxy mortar in order to form the recessed sections. The rear surface of the modular heating section 10 and the adjacent surface of the recessed section 30 of the wall 12 are both coated with a thin layer of bonding epoxy and suitable anchors 28 are situated in place in order to secure the modular heating sections 10 within their respective recessed sections 30. The outer surface 14 of each modular heating section 10 is preferably, but not necessarily, flush with the surface of the lock wall 11 in order to avoid a smaller vessel engaging a projecting lower edge of one of the modular sections and thereby damaging the section. After installation, each modular heating section 10 is connected to a header 20 which provides a source of energy to all of the modular heating sections 10. The modular heating sections 10 may be connected in series, in parallel, or independently, as required for the particular application. In this way, heat can be directed to specified modular heating sections 10 of the group of sections situated along the length of the wall of the navigation lock 12.

While electric cables have been utilized in the embodiment illustrated in FIGS. 2 and 3 of the drawing, the heater means 16 utilized can likewise comprise piping made of plastic, copper or steel of suitable size to permit the flow of a desired heated liquid such as water or steam. The pipe may be of single or multiple circuits with adequate valve controls in order to direct the flow of heated liquid through the individual modular heating sections 10. As well, wire mesh or screening may be added to the section adjacent the front surface thereof in order to improve the conducting of heat over the surface. Further, while a mortar surface has been utilized, a greater amount of steel may be used to the point that it becomes the exposed material.

I claim:

1. A modular heating section for use in association with navigation lock walls, loading docks, ferry slips, or the like, said modular heating section comprising:

a rigid panel having means for securing the section to a navigation lock wall, loading dock, or the like, at a location where ice formation occurs, the panel made from a heat conducting mortar mix;

the panel including heater means situated therein, the heater means adapted to distribute heat throughout the modular heating sections, the mortar mix providing a suitable bonding to the heater means while providing increased compressive strength to the modular heating section, connector means operatively connected with the heater means, said connector means adapted to connect the heater means to an energy supply;

a rear surface of the modular heating section provided with a layer of heat insulating material, whereby heat transfer through the rear surface of the panel to the lock wall, loading dock, or the like is limited, the layer of heat insulating material provided on both sides thereof with a bonding layer in order to increase adhesion of the layer of heat insulating material to the modular heating section, said modular heating section adapted to prevent the accumulation of ice on lock walls, loading docks, ferry slips, or the like by providing heat to an outer surface of the modular heating section by means of the heater means, the outer surface of the section being provided with a smooth resistant surface to limit adherence of ice thereto, and to reduce wear thereof, said section including structural steel within the section intermediate the outer surface and the heater means, the structural steel adapted to strengthen the section and distribute heat generated by the heater means across the outer surface of the section, the modular heating section further including screening of conducting material intermediate the heater means and outer surface thereof, the heat conducting screening adapted to distribute heat to the outer surface of the section.

2. A series of modular heating sections according to claim 1, wherein the outer surface of each section is provided with a smooth abrasive resistant surface to limit adherence of ice thereto, and to reduce wear thereof.

3. A series of modular heating sections according to claim 1, wherein each section includes a plurality of reinforcing and heat distribution elements situated within the section intermediate the outer surface and the heater means, the reinforcing and heat distribution elements adapted to strengthen the section and distribute heat generated by the heater means across the outer surface of the section.

4. A series of modular heating sections according to claim 3, wherein the reinforcing and heat distribution elements comprise structural steel extending throughout the modular heating section.

5. A series of modular heating sections according to claim 2, wherein the layer of heat insulating material is provided on both sides thereof with a bonding layer in order to increase adhesion of the layer of heating insulating material to the modular heating section.

6. A series of modular heating section according to claim 1, wherein each modular heating section includes screening of conducting material intermediate the heater means and outer surface thereof, the heat conducting screening adapted to distribute heat to the outer surface of each section.

7. A series of modular heating sections according to claim 1, wherein the heater means comprises an electric cable which extends throughout the section in order to provide heat therein.

8. A series of modular heating sections according to claim 1, wherein the heater means comprises piping situated within each section, the piping adapted to direct the flow of heated liquid throughout the section.

9. A series of modular heating sections according to claim 1, wherein each section is made from mortar mix which provides a suitable bonding to the heater means while providing increased compressive strength to the modular heating section.

10. A series of modular heating sections according to claim 3, each section adapted to be fabricated in a horizontal position, thereby permitting proper locating relative to each other of the heater means, the reinforcing and heat distribution elements, and the layer of heat insulating material.

* * * * *